United States Patent [19]

Gagala

[11] 3,930,517

[45] Jan. 6, 1976

[54] SAFETY VALVE

[76] Inventor: Jerome W. Gagala, 2796 Patrick Henry Drive, Apt. 618, Pontiac, Mich. 48057

[22] Filed: Aug. 2, 1974

[21] Appl. No.: 494,174

Related U.S. Application Data

[63] Continuation-in-part of Ser. No. 478,252, June 11, 1974, abandoned.

[52] U.S. Cl. ..... 137/329.4; 137/71; 137/493.6; 137/614.2; 222/3

[51] Int. Cl.[2] ..... F17C 13/04

[58] Field of Search ..... 137/68, 71, 512.5, 613, 137/614.11, 614.14, 614.19, 614.2, 614.21, 329.4, 493.6, 614.06; 222/3; 251/144

[56] References Cited

UNITED STATES PATENTS

| | | | |
|---|---|---|---|
| 1,411,483 | 4/1922 | Floyd | 251/144 X |
| 1,698,616 | 1/1929 | Woodham | 137/71 X |
| 2,563,244 | 8/1951 | Holicer | 137/71 X |
| 3,405,732 | 10/1968 | Dow | 137/614.21 X |
| 3,701,363 | 10/1972 | Schuler | 222/3 X |

*Primary Examiner*—Irwin C. Cohen
*Assistant Examiner*—Richard Gerard
*Attorney, Agent, or Firm*—Basile and Weintraub

[57] ABSTRACT

A high pressure gas tank safety and service valve which comprises a body portion that sealingly engages a threaded opening of a high pressure gas tank. The valve has a flow passage that communicates the interior of the gas tank to an outlet port of the safety and service valve; the flow passage including first and second axially spaced valve seats which are, respectfully, engageable by first and second valve members interconnected by a safety rod. The first valve member is operable to open and close communications between the interior of the high pressure gas tank and the outlet port of the valve to permit selected exhausting of the gas tank. The second valve member is normally bias toward engagement with the second valve seat and in the event of a fracture resulting in the escape of gas, the second valve member will automatically close communications from the tanks. A third valve seat disposed between the interior of the tank and the second valve member is engagable by a third valve operable to close communication with the interior of the tank when the pressure therein drops to a predetermined minimum valve. The third valve member carries a valve element which facilitates repressurization of the tank while the third valve member is engaged with its associated valve seat.

2 Claims, 5 Drawing Figures

SAFETY VALVE

CROSS REFERENCE TO RELATED APPLICATIONS

The present application is a continuation-in-part application of co-pending U.S. patent application Ser. No. 478,252 filed June 11, 1974 and now abandoned.

BACKGROUND OF THE INVENTION

I. Field of the Invention

The present invention relates to safety and service valves for high pressure gas tanks and, in particular, for a new and improved valve for compressed gas tanks which is capable of releasing high pressure gas as desired, but which will shut off the flow of gas in the event of a rupture of the valve and which will maintain the pressure in the tank above a predetermined minimum value.

II. Description of the Prior Art

Compressed gases contain energy that is generally proportional to the pressure and volume of the compressed gas and such compressed gases are capable of performing tremendous amounts of work. Thus the sudden release of a compressed gas, such as during the rupture of the service valve on a high pressure tank, may be very hazardous. The equipment that is used to compress gases to a high pressure is expensive, and it is a common practice to compress the gas to a high pressure at a central location and transport the compressed gas in high pressure tanks. These tanks can be as destructive as a bomb should they rupture because of the high pressure at which thes tanks are maintained, and thus as a safety precaution, there is a common practice to have only one opening in the tanks for permitting access to the gas contained within the tank. These openings are generally small and are threaded to permit the connection of a closure valve or shut-off valve either of which are exceedingly rugged in their construction but nevertheless are weaker than the tank structure itself, and thus if the tanks are accidently dropped or the valve bodies otherwise hit, the valve body may crack off externally from the tank on which it is mounted. The violent release of gas which occurs when the valve bodies are broken produces a tremendous thrust capable of blowing a tank through a solid brick wall. The tremendous hazards which these bottles create has long been recognized, and to guard against this hazard cylinders are shipped with a protective cap; however, these protective caps provide protection only while the cap is on the tank and the tank is being transported. During use the cap must be removed to gain access to the connection of the valve for purposes of utilizing the gases within the tank.

It would therefore be desirable to provide a safety and service valve for high pressure gas tanks which eliminates the aforementioned hazard tha occurs when a tank shut-off valve is inadvertently knocked off the tank on which it is installed. Examples of safety and service valves for high pressure gas tanks are disclosed in U.S. Pat. Nos. 1,525,775, 1,698,616, 2,563,244, 2,765,801, 3,480,183 and 3,648,893.

In certain applications it is necessary that a minimum amount of pressurized gas remain in the tank. This is especially desired in oxygen holding tanks. It would therefore be desirable to provide a safety and service valve for high pressure gas tanks which has all of the advantages described hereinbefore, and one which will prevent the pressure within a gas tank from falling below a predetermined amount.

SUMMARY OF THE INVENTION

The present invention, which will be described subsequently in greater detail, comprises a safety and service valve for high pressure tanks that functions to relieve high pressure gas from a high pressure tank, yet is adapted to shut off escaping gas in the event of a rupture of the service valve. Valve means are also provided for maintaining the pressure in the tanks at some predetermined minimum value while permitting repressurization of the tanks.

It is therefore an object of the present invention to provide a new and improved safety and service valve for high pressure gas tanks.

It is a further object of the present invention to provide such a safety and service valve for high pressure gas tanks which eliminates the hazard associated with a ruptured valve.

It is yet another object of the present invention to provide a means for maintaining a minimum amount of pressured gas within a tank during normal operation.

Other objects, advantages and applications of the present invention will become apparent to those skilled in the art of safety and service valves for high pressure gas tanks when the accompanying description of one example of the best mode contemplated for practicing the invention is read.

BRIEF DESCRIPTION OF THE DRAWING

The description herein makes reference to the accompanying drawing wherein like reference numerals refer to like parts throughout the several views, and in which.

DESCRIPTION OF THE PREFERRED EMBODIMENT

Figure 1:
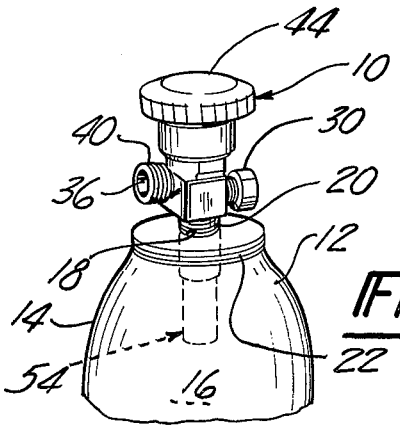
FIG. 1 is a perspective view of the high pressure gas tank having a safety and service valve constructed in accordance with the principles of the present invention.

Referring now to the drawing and, in particular, to FIG. 1 wherein there is illustrated one example of the present invention in the form of a service and safety valve 10 which is utilized as a shut-off valve for a high pressure gas tank 12. The high pressure gas tank 12 is typical of the tank models that are commercially available and generally comprises an outer metal, hollow shell 14 which encloses the interior 16 within which a high pressure gas is stored. The upper end of the tank 12 has an opening 18 which is threaded to receive the threaded end 20 of the safety valve 10. The tank 12 is also provided with an externally threaded section 22 which is adapted to receive a protective cap (not shown) that generally protects the valve 10 against lateral blows during transportation; however, the cap must be removed in order to remove the pressurized gas from within the tank 12 by means of the valve 10.

As aforementioned, the safety and service valve 10 generally comprises the tank sealing threaded portion 20 which is adapted to fit into and close off the threaded opening 18 of the high pressure tank 12 on which the valve 10 is installed. As can best be seen in FIG. 2, the valve 10 further comprises an axially extending passageway 24 which communicates with the internal chamber 16 of the tank 10 by means of a safety valve element 54. At the mid-section of the valve 10 the axially extending passage 24 opens into a transverse passage 26 that communicates with a rupture disc 28 that is held over the end of the transverse passage 26 by an annular hold down washer 29 and a threaded hold down nut 30. The rupture disc 28 is set to burst at some predetermined pressure and the gas exiting therefrom is vented through lateral opening 32 in the hold down nut 30. All of the aforementioned elements are conventional in construction and therefore a further description of the same is not necessary.

The upper end of the passage 24 terminates in a valve seat 34 which, in turn, communicates with a lateral extending passage 36 that forms the outlet port of the service valve 10. The port 36 has an outer threaded surface 40 to permit the connection of a suitable hose such that the high pressure gas within the tank 12 may be withdrawn as desired. Communication between the axial passage 24 and the outlet port 36 is controlled by means of a valve member 42. The valve member 42 is movable toward the valve seat 34 and engagable therewith to close communication and movable away from the valve seat 34 to permit the flow of fluid from the axial passage 24 to the outlet port 36. Movement of the valve member 42 is accomplished by means of a handle 44 that is connected to the valve member 42.

The valve member 42 has an upper portion 46 which is threaded to engage a mating threaded section 47 formed in the interior of the valve 10. The section 46 is provided with a diametrically extending slot 48 which is the coupling means between the handle 44 toward and away from the valve seat 34. The valve member 42 is rotated by a valve stem 50 having a tang end portion which fits into the slot 48 and a collar portion 51 which is received in an internal counter bore 53 of a element forming the inner end of the handle 44. It can thus be seen that as the handle 44 is rotated in one direction, the valve member 42 will be moved toward the valve seat 34 to engage the same and fluidly seal the axial passage 24 from the outlet port 36 and the interior chamber 16 of the high pressure tank. When the handle 44 is rotated in an opposite direction the valve member 42 is moved off of the valve seat 34 and fluid communication between the outlet port 36 and the interior chamber 16 of the tank is again open.

Figure 5:
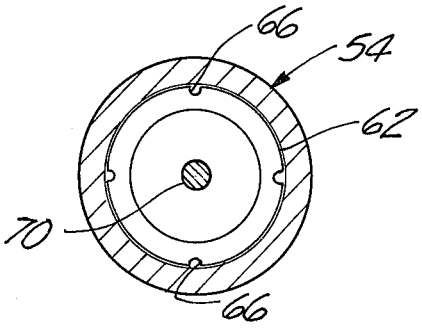
FIG. 5 is a cross-sectional view of the service and safety valve taken along line 5—5 of FIG. 3.

The lower end of the valve 10 is counter bored to form a threaded section 52 which threadedly receives the safety valve element 54 that forms a portion of the flow passage 24 in that the axial flow passage 24 communicates with the interior chamber 16 of the tank 12 by means of an axial bore 56 and the interior chamber 57 of the safety valve element 54. Within the chamber 57 the safety valve element 54 is provided with a main valve seat 60 which is engagable by a cylindrically shaped valve member 62 that is, in turn, bias by coil spring 64 toward a sealing engagement with the seat 60 to prevent fluid communication between the chamber 16 and the outlet port 36 for a purpose to be described hereinafter. It should be noted that the opposite sides of the movable valve member 62 are in communication with the high pressure gas within the interior of the tank 16; that is, the upper end of the valve member 62 which normally engages the valve seat 60 is in constant communication with the high pressure gas via axial passageways 66 (FIG. 5) in the form of grooves extending the full length of the valve member 62. The opposite end of the coil spring 64 engages a secondary valve member 65 to bias the same into a sealing engagement with a valve seat 68 defined by a circular O-ring 69 affixed by an adhesive or the like, to a circular recess 71.

The movable valve member 62 is normally maintained in an open position by means of a safety rod 70; that is, the valve member 62 is normally spaced from the valve seat 60 so that the flow of gas from the tank interior 16 to the outlet passage 36 is unrestricted. The safety rod 70 has its upper end affixed to the valve member 42 while its lower end is loosly seated within a bore 72 within the valve member 62. It can thus be seen that as the valve 42 is opened and closed it will exert a force on the safety rod 70 which always maintains the valve member 62 in an open position. It can also be seen that if the valve 10 is fractured at a point above the threaded section 20, to the extent that the valve is completely broken off, the valve safety rod 70 will also be broken (or at a minimum removed from the slot 72); since there will be a sudden pressure drop across the valve member 62 because of the rupture of the valve 10, the pressure differential across the valve member 62 will be such as to immediately drive the valve member 62 upwardly into a sealing engagement with the valve seat 60. This movement of the valve member will be aided by means of the spring 64. Once closure of the flow passage 24 is obtained by means of the seating of the valve member 62 on the valve seat 60, the pressure within the tank 12 will maintain the valve member 62 in a closed position, and the aforementioned hazard of a propelled high pressure tank is avoided.

The spring 64 is designed to seat the valve member 65 against the valve seat 68 when the pressure of the fluid within the tank 12 drops to some predetermined value, say 25PSI. When the pressure drops to the predetermined value, the valve member 65 moves to the position illustrated in FIG. 2 and closes off further communication with the interior 16 and, thus, maintains some minimum amount of gas within the tank 12.

Figure 3:
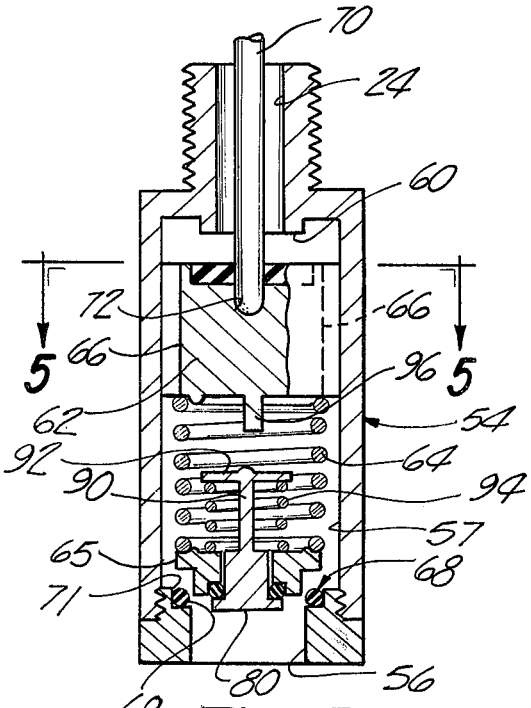
FIG. 3 is a fragmentary, enlarged view of the safety and service valve illustrated in FIG. 2 with the valve being shown in a position to permit the discharge of pressure fluid from within the tank.

During normal operation, when the tank 12 is pressured to any value over the predetermined minimum amount, the pressure of the fluid within the tank 16 will exert a sufficient force against the valve member 65 to maintain the same open; that is, out of engagement with the valve seat 68 (FIG. 3). In this mode of operation, fluid will flow through the bore 56 and into the chamber 57 via valve seat 68. Fluid flows past the valve member 62 via axial passages 66 and into the outlet port 36 via passageway 24.

Figure 2:
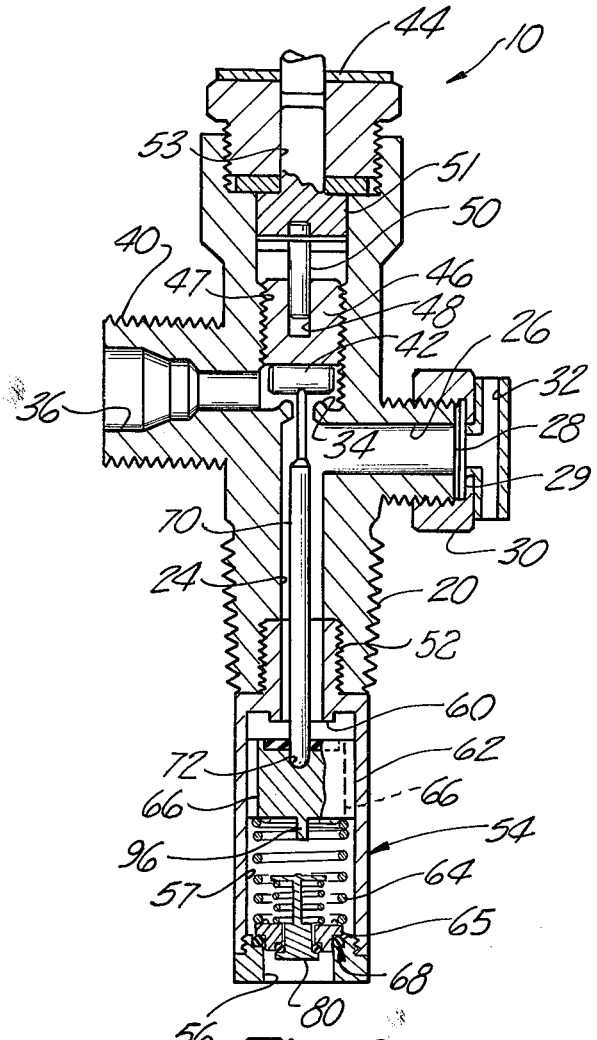
FIG. 2 is a longitudinal cross-sectional view of the safety and service valve illustrated in FIG. 1 with the valve being shown in a position for maintaining the pressure within the tank at a predetermined minimum.
Figure 4:
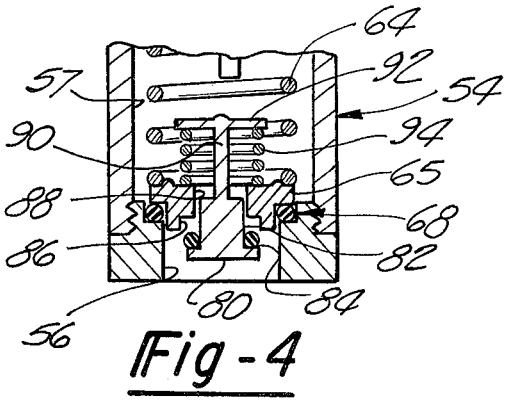
FIG. 4 is a fragmentary, enlarged view of the safety and service valve illustrated in FIG. 2 with the valve being shown in a position to permit the repressurization of the tank.

As can best be seen in FIG. 4, the valve member 65 carries a by-pass valve 80 that is circular in shape with a recess 82 that accommodates an O-ring 84 adapted to seat into and sealingly engage a valve seat defined by a circular recess 86 formed at the inner end of an axial bore 88 extending through the central portion of the valve member 65. The valve member 80 includes a post 90 that terminates in a circular retainer 92 that supports one end of a coil spring 94 sandwiched between the retainer 92 and the upper surface of the valve member 65 so as to normally urge the valve member 80 into a sealing engagement with seat 88 as shown in FIGS. 2 and 3. The valve member 80 is lifted off of the seat 88 (FIG. 4) to provide communication with the interior 16 of the tank 12 for the purpose of recharging the tank 12. Since the spring 94 is of a relatively small size, any recharging pressure in excess of the aforementioned predetermined minimum will open the valve member 80.

A finger 96 (FIG. 3) on the lower end of the main valve 62 permits the manual opening of the valve 80.

It can thus be seen that the present invention has provided a new and improved safety valve which not only prevents the propelling of a high pressure tank when its shut-off valve has been ruptured, but provides a means for maintaining the pressure in a high pressure gas tank at some predetermined minimum valve.

It should be noted that applicant's reference to the rupture of the valve does not refer to the rupturing of the diaphragm 28 as the rupturing of the diaphragm 28 does not result in the operation of the safety valve 54.

It should also be noted that the present design of applicant's safety valve 54 commits the simple modification of existing service valves so that the safety valve 54 may be simply incorporated therein by providing a threaded passage 52 in existing commercially available service valves.

It should also be noted that the present invention has advantages over the prior art atructure described hereinbefore, in that it functions to provide a total stoppage of the gas which is within the cotainer and, thus, prevent the possibility of a fire exploding or a person being overcome by a toxic gas that may be in the container. It may be also understood by those skilled in the art of such service and safety valves, that the present invention as disclosed may be fabricated with the safety valve 54 being of an integral construction with the upper portion of the safety valve, all of which will result in a single unit that is simpler to fabricate and, thus, less expensive to manufacture.

Although several forms of the present invention have been disclosed, it should be understood by those skilled in the art of safety and service valves, that other forms may be had, all coming within the spirit of the present invention and scope of the appended claims.

What is claimed is as follows:

1. A combination safety and service valve for closing and opening a high pressure tank, said combination safety and service valve comprising:

a body having an outlet port and a sealing portion engaging and closing said tank opening, said body having a flow passage extending through said tank sealing portion for communicating the interior of said pressure tank through a valve inlet with said outlet port;

a valve seat formed in said flow passage between said sealing portion and said outlet port;

a first valve member removably engagable with said valve seat to close communication between said tank interior and said outlet port;

means for actuating said first valve member;

a second valve seat formed in said flow passage between said sealing portion and said tank interior;

a second valve member engagable with said second seat to close communication beyond said second seat;

biasing means urging said second valve member into engagement with said second valve seat;

means connecting said first valve member to said second valve member to maintain said second valve member open during normal operation of said first valve member and responsive to displacement of said first valve member from normal valving positions to permit seating of said second valve member;

first valve means operable to close communication between said tank interior and said valve outlet port when the pressure of the fluid within said tank interior falls below a predetermined minimum value; and second valve means carried by said first valve means and operable to open communication between said valve inlet and said tank interior when said first valve means is closed and fluid under pressure is directed into said safety and service valve for pressurizing said tank interior.

2. A combination safety and service valve for closing and opening a high pressure tank, said combination safety and service valve comprising:

a body having an outlet port and a sealing portion engaging and closing said tank opening, said body having a flow passage extending through said tank sealing portion for communicating the interior of said pressure tank through a valve inlet with said outlet port;

a valve seat formed in said flow passage between said sealing portion and said outlet port;

a first valve member removably engagable with said valve seat to close communication between said tank interior and said outlet port;

means for actuating said first valve member;

a second valve seat formed in said flow passage between said sealing portion and said tank interior;

a second valve member engagable with said second seat to close communication beyond said second seat;

biasing means urging said second valve member into engagement with said second valve seat;

means connecting said first valve member to said second valve member to maintain said second valve member open during normal operation of said first valve member and responsive to displacement of said first valve member from normal valving positions to permit seating of said second valve member; and first valve means operable to close communication between said tank interior and said valve outlet port when the pressure of the fluid within said tank interior falls below a predetermined minimum value, said biasing means being a coil spring disposed between and in abuttment with said second valve member and said first valve means to provide a common bias for urging said first valve means to close communication between said inlet and said outlet and for urging said second valve member into engagement with said second valve seat.

* * * * *